United States Patent [19]

Gresens

[11] Patent Number: 4,559,680

[45] Date of Patent: Dec. 24, 1985

[54] TENSIONING MACHINE

[75] Inventor: Harry Gresens, Benningen, Fed. Rep. of Germany

[73] Assignee: Bruckner Trockentechnik GmbH & Co., Leonberg, Fed. Rep. of Germany

[21] Appl. No.: 586,400

[22] Filed: Mar. 5, 1984

[30] Foreign Application Priority Data

Mar. 8, 1983 [DE] Fed. Rep. of Germany ... 8306640[U]

[51] Int. Cl.[4] ..... D06C 3/02

[52] U.S. Cl. ..... 26/74; 26/89; 26/91

[58] Field of Search ..... 26/74, 89, 91, 76; 34/158; 33/125 R

[56] References Cited

U.S. PATENT DOCUMENTS

| | | | |
|---|---|---|---|
| 3,239,618 | 3/1966 | Sengel | 26/76 X |
| 3,382,554 | 5/1968 | Harmon et al. | 26/91 |
| 4,241,507 | 12/1980 | Clarey | 26/91 X |

FOREIGN PATENT DOCUMENTS

| | | | |
|---|---|---|---|
| 2232501 | 2/1974 | Fed. Rep. of Germany | 26/91 |
| 142574 | 7/1980 | German Democratic Rep. | 26/89 |
| 7309832 | 1/1974 | Netherlands | 26/91 |

*Primary Examiner*—Robert R. Mackey
*Attorney, Agent, or Firm*—Learman & McCulloch

[57] ABSTRACT

A tensioning machine for use in the heat treatment of textile fabric for controlling the widthwise dimension of the fabric comprises a pair of continuously movable tenter chains for moving the fabric along a path and supported by guides which are coupled to one or more rotatable spindles operable to adjust the guides transversely of such path. One end of each spindle is both rotatable and axially movable and cooperates with a force sensitive device that is operable in response to an alteration in the force applied thereon to generate a signal. Each spindle is coupled to a rotary drive, the operation of which is controlled by the signal generated by the associated force sensitive device.

14 Claims, 5 Drawing Figures

TENSIONING MACHINE

The invention relates to a tensioning machine for the heat treatment of a continuously transported length of textile material which is guided widthwise in its movement.

BACKGROUND OF THE INVENTION

In the heat treatment of lengths of textile material in a tensioning machine, in addition to maintaining the material at a suitable temperature and for a sufficient period of dwell time, it is important that optimum tensioning of the lengths of textile material across their width (that is to say in a direction at right angles to the transport direction) is always ensured. In this connection, it should be borne in mind amongst other things that varying alterations in width and thur alterations in the transverse tension can occur over the length of the heat treatment section in the tensioning machine as a result of the selected temperature and transit time and as a function of the type of textile material undergoing treatment. In order to be able to control the widthwise material tension within the length of textile material according to a desired overall tension, various machine constructions have already been developed in which the spacing of the two continuously moving tensioning chains which hold a length of material on its longitudinal edges is set with the aid of at least one transverse width-adjusting spindle.

This type of construction is described in German Offenlegungsschrift No. 2,335,124. Here the width-adjusting spindle consists of two half spindles with threaded sections, the threaded section of one half spindle being threaded in the opposite direction to that of the other half spindle so that when the width-adjusting spindle rotates in one direction or the other the guide rails for the tension chains, which are held on the half spindles by means of threaded nuts, can be moved towards or away from each other. While one half spindle is axially fixed and provided with a spindle drive, the second half spindle is axially movable but connected to the first half spindle so as to be rotationally fixed. The outer end of this second half spindle is extended towards the outside by a rod and is there articulated on a forked one-arm control lever, the lower free end of which is articulated on the piston rod of a pneumatic or hydraulic cylinder and which in its central region cooperates with one or two control switches in such a way that the spindle drive motor arranged at the opposite end of the width-adjusting spindle can be actuated to create a greater or smaller distance between the chain guide rails or tensioning chains so that a maximum permissible or minimum necessary widthways tension can be maintained. The working pressure of the pnuematic or hydraulic operating cylinder should be a criterion for the textile material tension provided.

In a practical construction of the known tensioning machine described above, the control provided there for the heat treatment of carpet lengths and the like may be sufficiently accurate; however, in tensioning machines for other textile finishing processes, particularly for lengths of more delicate textile materials, e.g. tulle, curtains, material for outer clothing, or industrial fabrics, the control provided in order to maintain a desired widthwise tension must be capable of being effected with considerably greater precision than is described above. In addition this known construction involves comparatively high construction costs and requires a correspondingly large amount of space.

The object of the invention, therefore, is to provide a tensioning machine which has a simple, space-saving construction and is distinguished by an extremely sensitive control for the widthwise tensioning of the length of material.

SUMMARY OF THE INVENTION

In a tensioning machine according to the invention, the control element connected to the second spindle section consists of a force sensitive or measuring cell and it is therefore possible on the one hand to use an extremely sensitive control element for adjusting the widthwise tension and on the other hand to be able to fall back on an extremely simple structural and space-saving component which is commercially available. The way in which such force measuring cells operate is based upon the use of strain gauges, piezoelectrics and similar sensitive measuring arrangements. In addition a force measuring cell can be arranged most advantageously on an outer wall of the tensioning machine or the tensioning machine frame so that it is easily accessible from the outside and is protected against the high operating temperatures which frequently occur in the interior of the tensioning machine. Utilizing the measurement signals from the force measuring cell and associated electrical controls, a desired width adjustment of the rotating tensioning chains can be made in a suitable manner with the aid of the spindle drive by means of the width-adjusting spindle, the threaded nuts and the chain guide rails.

THE DRAWINGS

Further details and advantages of the invention are set out in the following description of an embodiment illustrated in the accompanying drawings, in which.

Figure 2:
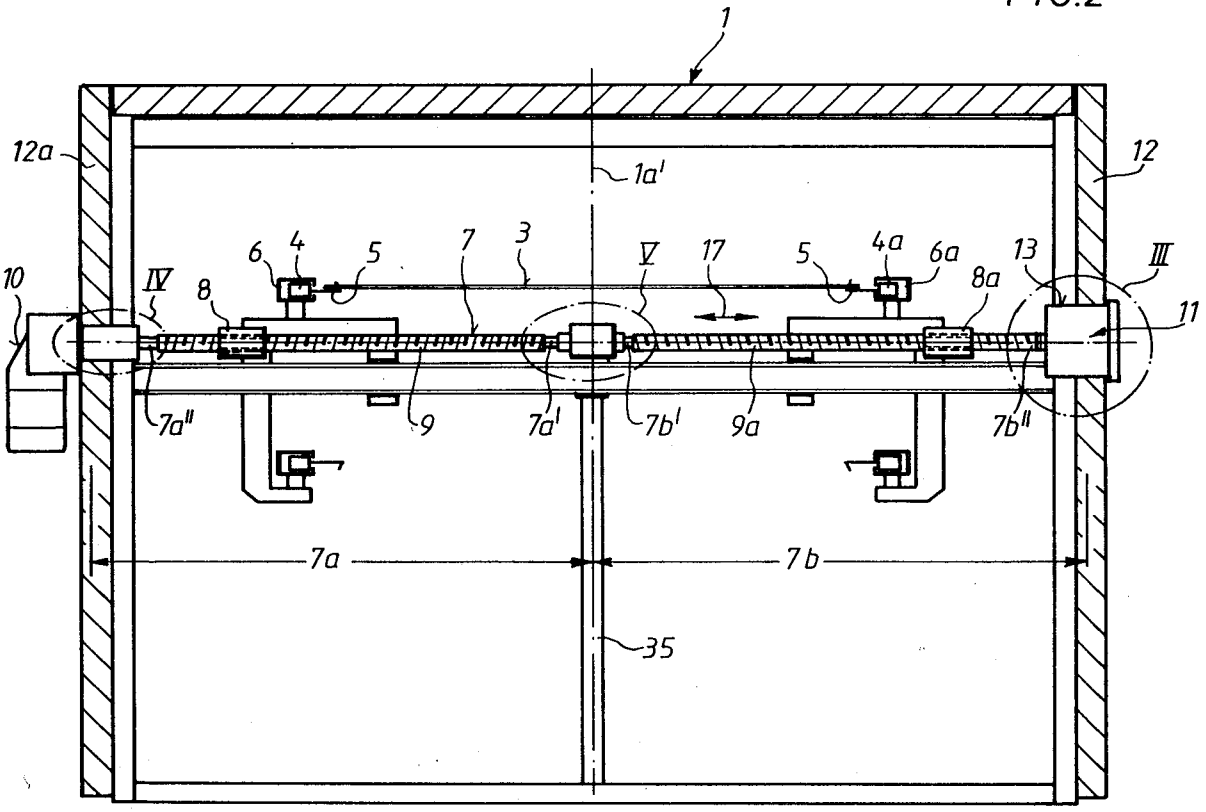
FIG. 2 is a simplified cross-sectional view through the tensioning machine approximately along the line II—II in FIG. 1.
Figure 3:
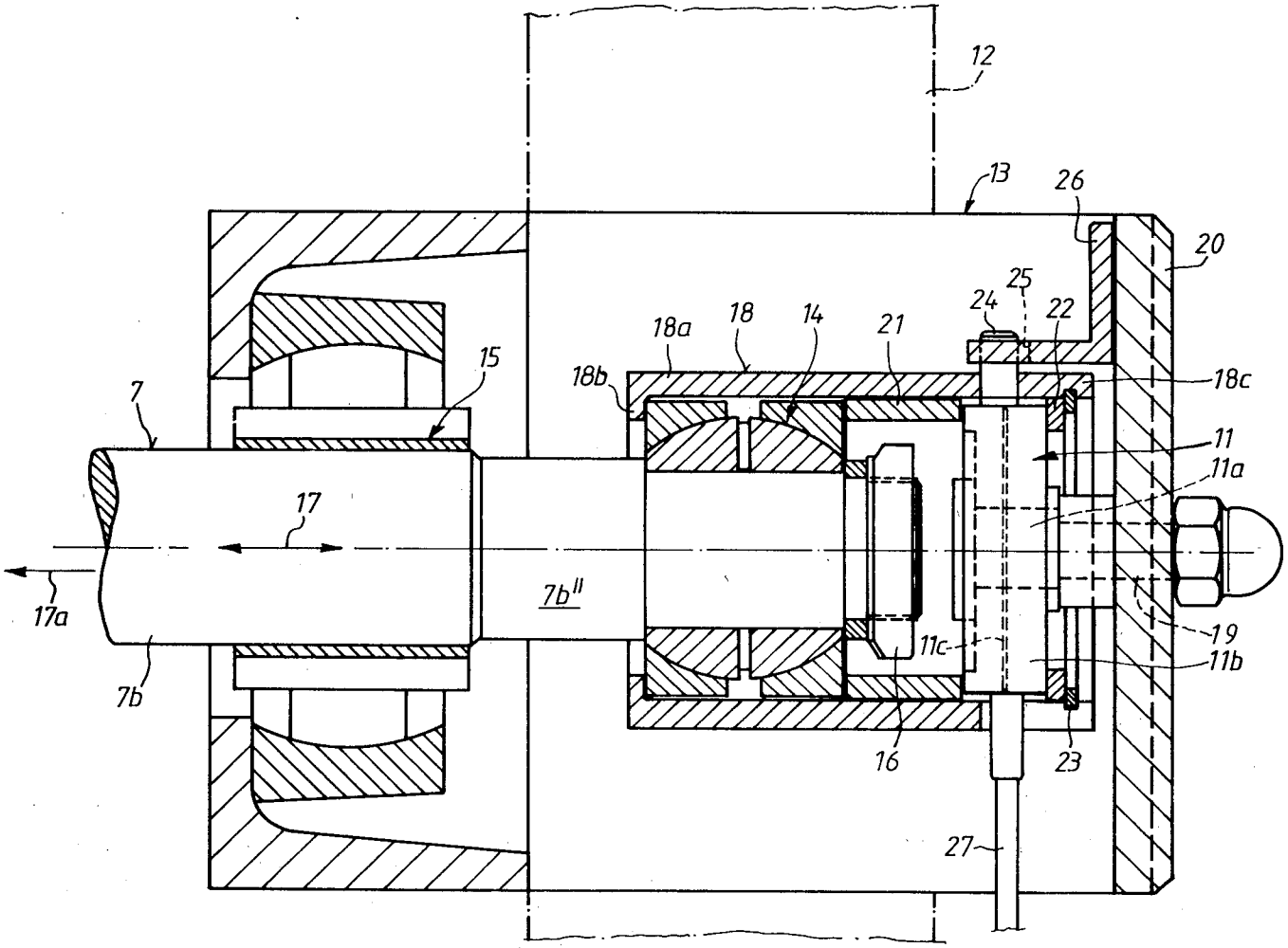
Figure 4:
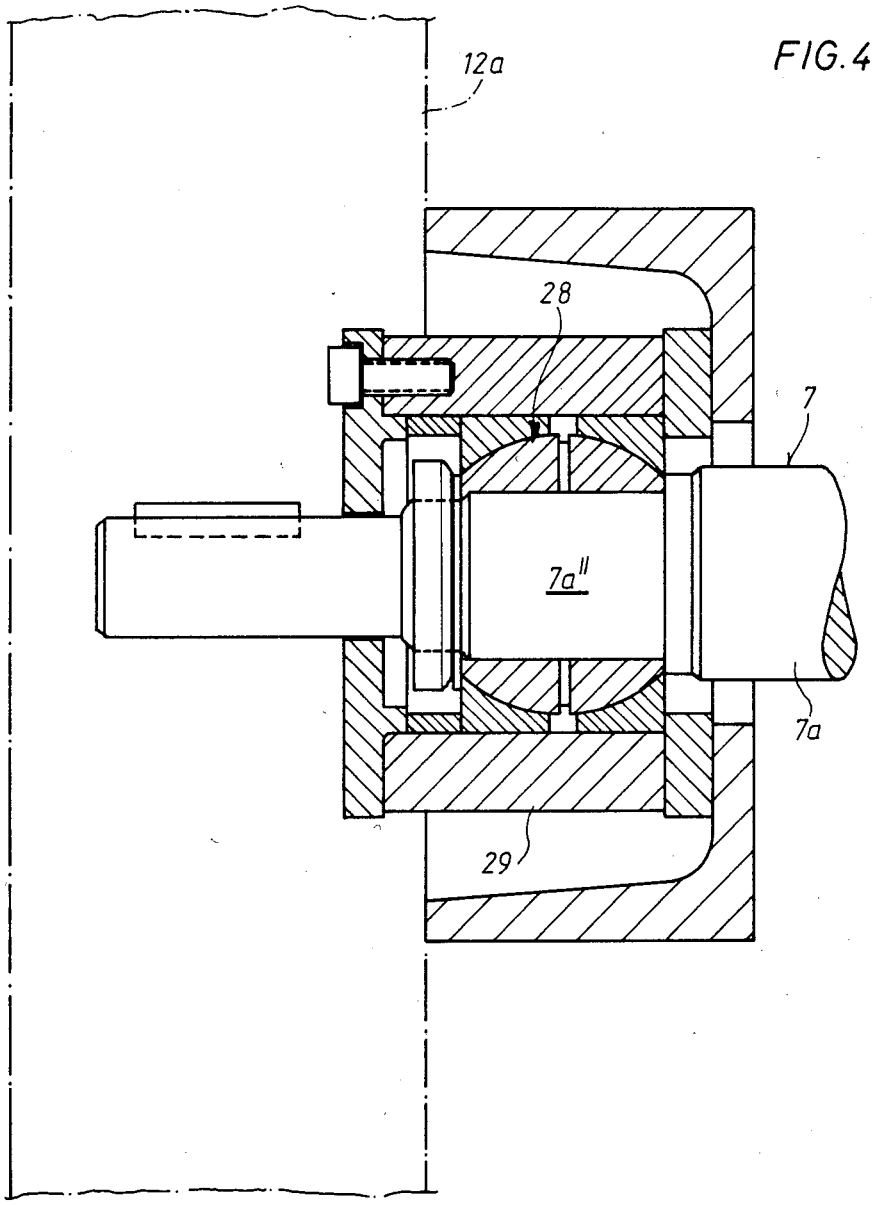
Figure 5:
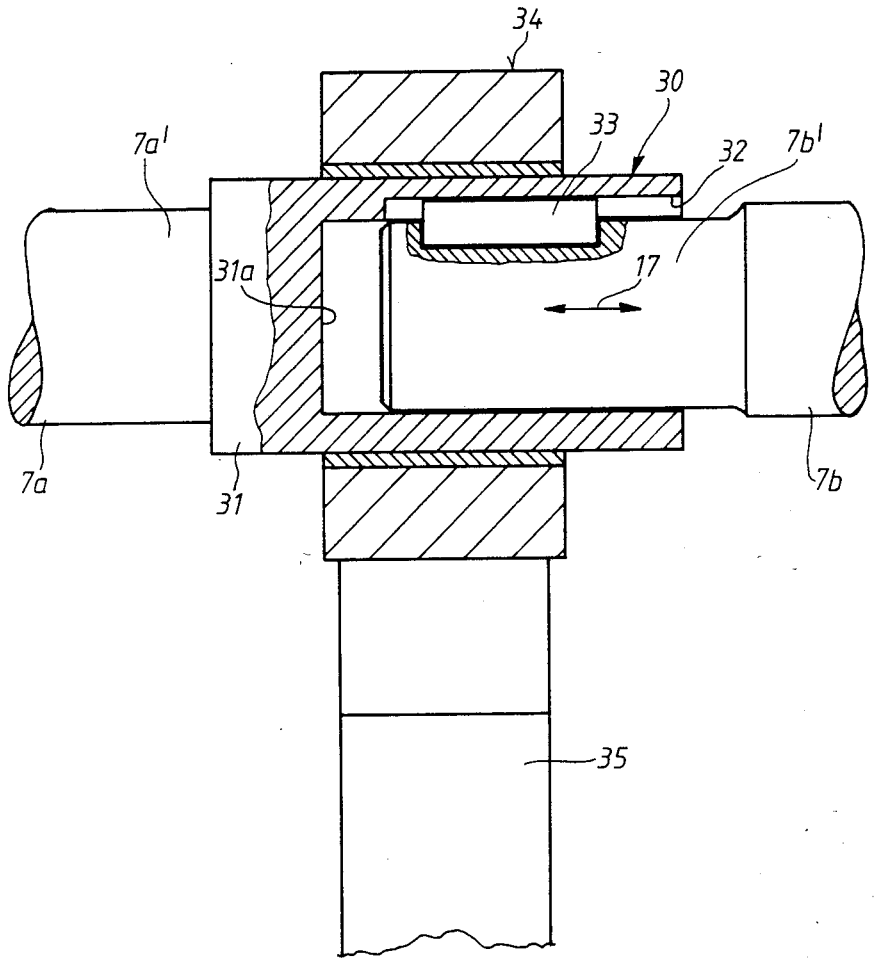

FIG. 3 is a cross sectional detail on an enlarged scale of section III in FIG. 2 and illustrates the assembly of the force measuring cell and the associated outer end of the second spindle section, including the relevant bearings; and FIGS. 4 and 5 are cross sectional views on an enlarged scale corresponding to the sections IV and V, respectively, in FIG. 2 and illustrating further bearing arrangements for the width-adjusting spindle.

DETAILED DESCRIPTION

First of all the general construction of the tensioning machine 1, in so far as it is of interest in the present case, will be explained with the aid of FIGS. 1 and 2. In the illustrated example, the tensioning machine 1 has an inlet zone E, three heat treatment zones $F_1$, $F_2$, $F_3$ and an outlet zone A. In this tensioning machine 1, a length of textile material 3 which is continuously transported in the direction of the arrow 2 can be tensioned widthwise and subjected to heat treatment, for example, dried, fixed or treated in a similar manner. Two continuously moving tenter or tensioning chains 4, 4*a* (cf. FIG. 2) serve in the usual way for continuous transport and tensioning of the length of textile material 3 by holding the two longitudinal edges 3*a*, 3*b* of the material with known retaining means, such as clip plates or pin plates (indicated at 5). The two tensioning chains 4, 4*a* are guided in conventional chain guide rails 6, 6*a* which hold the tensioning chains 4, 4*a* in the individual treatment zones at a distance from one another which corresponds to the necessary width of the length of textile material in each case.

Figure 1:
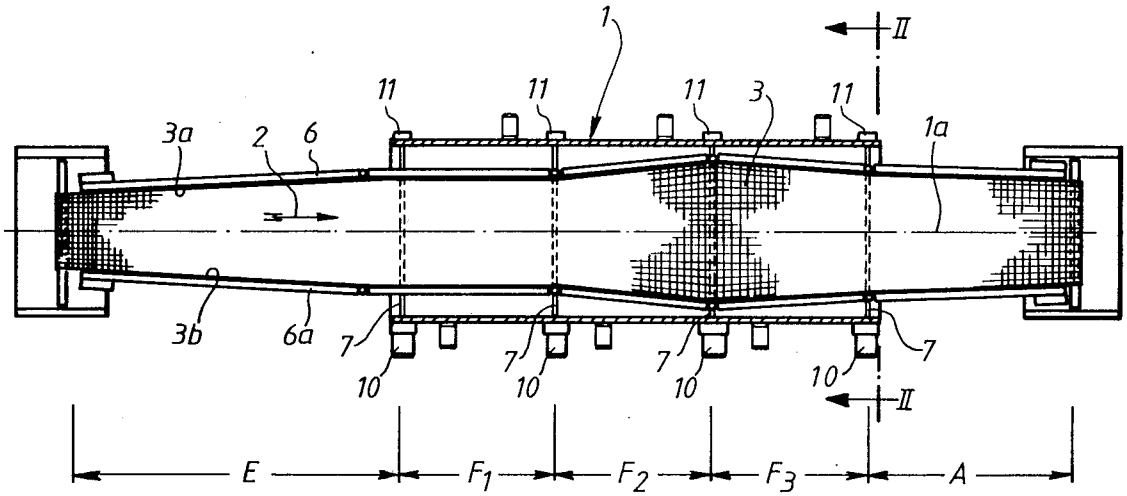
FIG. 1 is is a greatly simplified plan view of a tensioning machine with the top removed.

As can be seen clearly in FIG. 1, the two tensioning chains 4, 4*a* can be adjusted so that in the relevant zones E, $F_1$, $F_2$, $F_3$ and A they tension the length of textile material 3 and cause it to be increasingly stretched (divergent guiding of the tensioning chains), kept at the same width (parallel guiding of the tensioning chains), or allowed it to become increasingly narrow in width (convergent guiding of the tensioning chains). In this way, the tensioning layout shown in FIG. 1 is produced for the length of textile material 3.

For a tensioning layout running symmetrically to the longitudinal axis 1*a* of the tensioning machine, accurate measuring control and adjusting facilities must be provided for the relative spacing of the two continuously moving tensioning chains 4, 4*a* in order to ensure the optimum widthwise tension for the length of material 3 for any special type of treatment and material to be treated in any zone of the tensioning machine.

As has already been mentioned above, the distance between the tensioning chains is adjusted by means of the chain guide rails 6, 6*a* which are divided into a plurality of longitudinal sections which are articulated to one another, as is sufficiently known and indicated in FIG. 1. The distance between the two tensioning chains 4, 4*a* and thus the relevant material width is adjusted with the aid of width-adjusting spindles 7 which extend in the transverse direction of the machine and at least one of which is associated with a treatment zone. Each width-adjusting spindle 7 is preferably located in the region of the junction of two adjacent zones or the transition from one zone to another (cf. also FIG. 1).

FIG. 2 indicates in a simplified manner that the chain guide rails 6, 6*a* have threaded nuts 8, 8*a* each of which is screwed onto an appropriate threaded part 9, 9*a* of the width-adjusting spindle, these threaded parts having opposite threads so that when the width-adjusting spindle 7 turns in one or the other direction the chain guide rails 6, 6*a* are correspondingly moved towards one another or away from one another, uniformly in each case with respect to the longitudinal central plane 1*a* (cf. FIG. 2). With regard to the chain guide rails 6, 6*a*, it should be added that in the illustrated example these rails are intended for tensioning chains 4, 4*a* which move around continuously in a vertical plane and thus also extend into the region below the width-adjusting spindles 7.

Each width-adjusting spindle 7 is divided approximately in half into first and second spindle sections, the first spindle section 7*a* having the threaded part 9 and the second spindle section 7*b* having the opposing threaded part 9*a*. The inner ends 7*a*' and 7*b*', respectively of the two spindle section 7*a*, 7*b* are splined or otherwise suitably connected to each other—as is illustrated in greater detail in FIG. 5—so that they are fixed against relative rotation but can be moved towards or away from each other. The outer end 7*a*'' of the first spindle section 7*a* and thus one end of the whole width-adjusting spindle 7 is connected to a controllable and reversible spindle drive 10, while the opposite end, i.e., the outer end 7*b*'' of the second spindle section 7*b*, is connected to a force sensitive control element formed by a force measuring cell 11.

With the aid of FIG. 3 it will now be explained how the force measuring cell 11 is on the one hand connected to the axially outer end 7*b*'' of the second spindle section 7*b* and on the other hand is supported in a fixed position.

A type of bearing block 13 is fixed on or in an outer wall 12—which is merely indicated in FIG. 3—of the tensioning machine frame. This bearing block 13 contains a spherical segment bearing 14, which is constructed as a sliding bearing and is arranged directly on the outer end 7*b*'' of the second spindle section 7*b*, and a radial sliding bearing 15 which is arranged adjacent to the spherical segment bearing 14 in the direction of the inner end 7*b*' of the second spindle section 7*b*. While the stationary radial sliding bearing 15 supports the outer end 7*b*'' of the spindle section 7*b* so that it is rotatable but axially movable, the spherical segment bearing 14 is fixed on the end 7*b*'' of the spindle section 7*b* with the aid of a threaded clamping ring 16 so that it is not axially movable, i.e., this spherical segment bearing 14 participates in every movement of the second spindle section 7*b* in its axial direction (double arrow 17). This spherical segment bearing 14 is arranged inside the inner end 18*a* of a preferably cylindrical housing 18 which is directed towards the center of the tensioning machine and is supported towards the center of the tensioning machine by a flange 18*b* on the housing. However, the essential part of the force measuring cell 11 is also accommodated inside this housing 18, i.e., the force measuring cell 11 is arranged in axial extension of the outer end 7*b*'' of the second spindle section 7*b* a short axial distance therefrom. The force measuring cell 11, which is of conventional construction, has a first measuring cell part 11*a* which is arranged approximately centrally and is immovably fixed on the outer wall 12 with the aid of a screw 19 on an outer plate 20 of the bearing block 13. This first measuring cell part 11*a* is enclosed by a housing of a second measuring cell part 11*b* which has an approximately cylindrical external shape and is also arranged inside the cylindrical housing 18, but at the end 18*c* thereof adjacent the exterior. This second measuring cell part 11*b* is operatively connected to the first measuring cell part 11*a* by an inner measuring element 11*c* (e.g. a strain gauge), as will be explained in greater detail below. Inside the common housing 18 the spherical segment bearing 14 and the force measuring cell 11 are connected to each other, and thus to the outer end 7*b*'' of the second spindle section 7*b*, by the housing flange 18*b*, a spacer ring or spacer tube 21, a further spacer ring 22 and a clamping ring 23. The cell 11 and the outer end of the spindle section 7*b* are spaced apart, but are axially immovable relative to each other. However, the outer end 7*b*'' of the spindle section 7*b* can rotate freely within the cylindrical housing 18 and relative to the cell 11 because of the spherical segment bearing 14. The housing 18 and the second measuring cell part 11*b* are not rotatable relative to each other because of a housing pin 24 which projects radially outwards and is accommodated in a slot 25 in a bracket 26 fixed to the outer plate 20. An electrical cable 27 which is connected to electrical control means (not shown) of conventional construction leads out from the force measuring cell 11.

The outer end 7*a*'' of the first spindle section 7*a* (FIG. 4), that is, the end of the spindle which is connected to the spindle drive 10, is mounted in a spherical segment bearing 28 which in this case is fixed with its housing 29 on the other outer wall 12*a* of the frame of the tensioning machine. In contrast to the opposing end of the spindle, which is connected to the force measuring cell 11, this end of the spindle drive is fixed so as to be immovable in the axial direction. The spindle drive 10 (cf. FIG. 2) to be associated with this end of the spindle can be constructed in any suitable manner so that it can be controlled by means of the aforementioned control arrangement in order to drive the width-adjusting spindle in one direction of rotation or the other depending upon whether the tensioning chains 4, 4*a* are to be moved away from each other or towards each other.

The connection 30 between the inner ends *7a'*, *7b'* of the two spindle sections *7a* and *7b* is shown in detail in FIG. 5 and comprises a sleeve part 31 on the inner end *7a'* of the first spindle section *7a* which is open towards the second spindle section *7b*. The end *7b'* of the second spindle part *7b* is received in the sleeve 31 and is so dimensioned as to be capable of sliding movement in the axial direction. However, the inner end *7b'* of the second spindle section *7b* is a sufficient distance from the sleeve base 31*a* that there is enough axial clearance available in the event of axial movements (double arrow 17) of the second spindle section *7b* during operation. In order for the rotary movement imparted to the first spindle section *7a* by the spindle drive 10 to be transmitted to the second spindle section *7b* as well, the two inner spindle ends *7a'*, *7b'* are connected to each other so as to be fixed against relative rotation, for example by means of a keyway 32 and a key 33.

At the connection 30 between the two spindle sections *7a* and *7b*, these two sections are supported by means of the sleeve part 31 in a radial sliding bearing 34 so as to be rotatable, and this radial sliding bearing 34 is additionally supported, as indicated in FIG. 2, by means of a support 35 on the base. Thus the width-adjusting spindle 7 is reliably supported over its whole length (i.e., across the width of the machine), and the preferred use of spherical segment bearings on the outer spindle ends permits a sufficiently rotatability of the spindle 7.

In the preferred embodiment each of the width-adjusting spindles 7 of the tensioning machine 1 is equipped at one end with an individual spindle drive 10 and a force measuring cell at the opposing end so that by means of appropriate, known control means, each individual spindle can be adjusted extremely accurately and sensitively to the necessary tension independently of other spindles. Thus, if a length of textile material 3 is to undergo heat treatment during operation of the machine, the force measuring cell associated with each width-adjusting spindle can be set to a predetermined mean value. If during treatment of the length of material 3 the tension deviates from the predetermined widthwise tension, this can be determined extremely accurately by the force measuring cell 11 which generates and transmits a corresponding signal to the control means so that the control means sets the relevant spindle drive 10 in operation in the necessary manner so that the widthwise tension of the length of textile material is restored to the predetermined tension by means of the chain guide rails 6, 6*a* and the tensioning chains 4, 4*a*.

If one assumes that the widthwise tension in the length of textile material 3 has become too great, then a corresponding traction may be exerted in the direction of the arrow 17*a* (FIG. 3) on the second spindle section *7b* by means of the tensioning chain 4*a*, the chain guide rail 6*a* and the threaded nut 8*a* (cf. also FIG. 2). Since the outer end *7b* is connected to the housing 18 and the second measuring cell part 11*b* so as to be axially fixed to the spindle, these elements also move inside the bearing block 13 in the direction of the arrow 17*a*, whereas the first measuring cell part 11*a* remains immovable, i.e., stationary, so that a signal is generated by the inner measuring element 11*c* of the force measuring cell 11. This signal is passed via the electrical cable 27 to the control means which in turn, as already mentioned, supplies in known manner a corresponding control signal to the spindle drive 10 as regards the desired new setting for the widthwise tension. If the predetermined widthwise tension for the length of textile material 3 is relaxed, this is followed by the sensing of an alteration in the predetermined tension and the generation of a signal to operate the spindle drive 10 in the reverse manner. With this extremely compact and very simply designed construction and arrangement, particularly that of the force sensitive element (force measuring cell), an extremely sensitive adjustment of the widthwise tension can be achieved at any time, which is important particularly for delicate textile materials.

Finally, it should be borne in mind that the spindle construction described in detail on the basis of FIGS. 2 to 5 with its advantageous control possibilities does, of course, apply to all the spindles 7 of the tensioning machine. However, in addition to the control, as described in detail, of the width setting by appropriate adjustment of the working width at the point of measurement, a further control function is provided which is at least as important: the sensing of the force is also necessary in particlar in order to prevent the breaking loads of the chains from being exceeded by excessively high tensions and also to adjust the widthwise guiding, i.e., the overall tension, in order to keep the tensions within limits which are beneficial for example for thermofixing and are also suitable for achieving the correct product width.

What is claimed is:

1. In a tensioning machine for tensioning widthwise a length of fabric material continuously moved lengthwise along a path leading to and through at least one treatment zone, said machine having a pair of spaced apart, continuously movable members fitted with means for holding opposite sides of the material and tensioning the latter, said movable members being supported by guides that are relatively adjustable transversely of said path by means of a rotatable spindle connected to at least one of said guides, said spindle having two sections coupled together for conjoint rotation and relative axial movement, drive means connected to one of said spindle sections for driving the latter to effect relative movement of said guides transversely of said path, and control means coupled to the other of said spindle sections, the improvement wherein said control means comprises electrical force sensitive cell means operable to sense a change in widthwise tension of said material, said control means having two parts, one of said parts being connected to said other of said spindle sections for axial movement therewith and the second of said parts being fixed against axial movement, said cell means being responsive to relative axial movement of said first and second parts for generating an electrical signal, and means electrically coupling said cell means to said drive means to operate the latter.

2. A tensioning machine according to claim 1 wherein said other of said spindle sections is rotatable relative to said one of said parts of said force sensitive cell means.

3. A tensioning machine according to claim 1 wherein said other of said spindle sections is rotatable relative to both of said parts of said force sensitive cell means.

4. A tensioning machine according to claim 1 wherein said first part of said force sensitive cell means is axially spaced from said other of said spindle sections.

5. A tensioning machine according to claim 1 including means journalling said other of said spindle sections in a housing, said force sensitive cell means also being accommodated in said housing, and means carried by said housing for axially spacing apart said other of said spindle sections and said force sensitive cell means.

6. A tensioning machine according to claim 5 wherein said housing is fixed against rotation, said one of said parts of said force sensitive cell means being restrained against rotation by said housing.

7. A tensioning machine according to claim 1 wherein both of said spindle sections are connected to the means for holding opposite sides of said material, the connection between said spindle sections and the respective means for holding opposite sides of said material effecting conjoint movement of said holding means in opposite directions in response to operation of said driving means.

8. A tensioning machine according to claim 1 wherein said spindle sections are supported in common bearing means where said sections are coupled together.

9. A tensioning machine according to claim 1 wherein said spindle sections are coaxial and have their confronting ends coupled together, each of said spindle sections having its other end journalled in a spherical bearing.

10. A tensioning machine according to claim 9 wherein one of said spherical bearings is movable axially of said spindle sections and the other of said spherical bearings is fixed.

11. A tensioning machine according to claim 9 including a common slide bearing supporting said spindle sections at their confronting ends.

12. In a tensioning machine for tensioning widthwise a length of fabric material continuously moved lengthwise along a path leading to and through at least one treatment zone, said machine having a pair of spaced apart, continuously movable members fitted with gripping means for holding opposite sides of said material and tensioning the latter, said movable members being supported by guides that are relatively adjustable transversely of said path to vary the spacing between said movable members and the gripping means fitted thereon, a spindle mounted for rotation about an axis transverse to said path, said spindle having two sections coupled together for conjoint rotation and relative axial movement, drive means for rotating said spindle, and means coupling said spindle to at least one of said guides for moving the latter transversely of said path in response to rotation of said spindle, the improvement comprising means mounting said spindle for axial movement of one section thereof transversely of said path and independently of its rotation, electrical force sensitive cell means, and means coupling said one spindle section and said force sensitive cell means for applying a force on the latter in response to axial movement of said one spindle section, said force sensitive cell means being responsive to an alteration in the force applied thereon to generate an electrical signal, and means coupling said force sensitive cell means to said drive means for effecting operation thereof.

13. A tensioning machine according to claim 12 wherein said mounting means for said spindle comprises a housing at one end of said one spindle section and into which the latter extends, said force sensitive cell means also being accommodated in said housing.

14. A tensioning machine according to claim 13 including force transmitting means reacting between said one end of said one spindle section and said force sensitive cell means for altering the force applied thereon by said one spindle section in response to axial movement thereof.

* * * * *